United States Patent [19]

Forbes II

[11] 4,417,802

[45] Nov. 29, 1983

[54] PARTICLE DISPENSER

[75] Inventor: Richard L. Forbes II, Walworth, N.Y.

[73] Assignee: Xerox Corporation, Stamford, Conn.

[21] Appl. No.: 322,999

[22] Filed: Nov. 19, 1981

[51] Int. Cl.[3] ..... G03G 15/00

[52] U.S. Cl. ..... 355/3 DD; 355/14 D; 118/653; 118/658; 430/120; 430/122

[58] Field of Search ..... 355/3 DD, 14 D; 118/647, 651, 653, 658, 655, 656; 430/121, 122, 123, 120, 413

[56] References Cited

U.S. PATENT DOCUMENTS

| | | | |
|---|---|---|---|
| 4,067,295 | 1/1978 | Parker et al. | 355/3 DD X |
| 4,261,290 | 4/1981 | Yamashita et al. | 355/3 DD X |
| 4,324,483 | 4/1982 | Tagawa et al. | 355/3 DD |
| 4,351,604 | 9/1982 | Karasawa et al. | 355/3 DD X |
| 4,353,637 | 10/1982 | Parker | 355/3 DD |

*Primary Examiner*—A. C. Prescott

*Attorney, Agent, or Firm*—H. Fleischer; J. E. Beck; R. Zibelli

[57] ABSTRACT

An apparatus which dispenses toner particles into the chamber of a housing storing developer material. The toner particles are stored in the container and dispensed from the uppermost portion thereof.

8 Claims, 3 Drawing Figures

PARTICLE DISPENSER

This invention relates generally to an electrophotographic printing machine, and more particularly concerns an improved particle dispenser for use in the development system thereof.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document being reproduced. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently affix it to the copy sheet in image configuration.

A suitable developer material frequently comprises carrier granules having toner particles adhering triboelectrically thereto. This two-component mixture is brought into contact with the photoconductive surface. Toner particles are attracted from the carrier granules to the latent image. These toner particles adhere to the latent image so as to form a powder image on the photoconductive surface.

Various methods have been devised for applying developer material to the latent image. For example, the developer material may be cascaded over the latent image with the toner particles being attracted from the carrier granules thereto. Other techniques utilize magnetic field producing devices which form brush-like tufts extending outwardly therefrom in contact with the photoconductive surface. In any system, it is apparent that during the development process, toner particles are depleted from the developer material. Thus, additional toner particles must be furnished to the developer material so as to maintain copy density at a substantially optimum level. In order to produce an efficient printing machine, it is necessary to conveniently and effectively replace the toner particles used during the formation of the copies. Hereinbefore, toner particles have been dispensed generally from a trough or hopper into the developer material. Exemplary prior art, such as U.S. Pat. No. 2,851,373 issued to Tregay et al. in 1958; U.S. Pat. No. 2,892,446 issued to Olden in 1959; U.S. Pat. No. 2,904,000 issued to Fisher et al. in 1959; U.S. Pat. No. 2,910,964 issued to Stavrakis et al. in 1959; U.S. Pat. No. 3,149,760 issued to Eichorn et al. in 1964; U.S. Pat. No. 3,888,394 issued to Tanaka et al. in 1975; and U.S. Pat. No. 3,898,956 issued to Andrako in 1975, all disclose dispensing toner particles from the bottom of the hopper storing a supply of toner particles therein.

In accordance with one aspect of the present invention there is provided an apparatus for dispensing particles. The apparatus includes means for storing a supply of particles therein. Means are provided for dispensing particles from the uppermost portion of the storing means.

Pursuant to another aspect of the present invention, there is provided an apparatus for developing an electrostatic latent image recorded on a photoconductive member. The apparatus includes a housing defining a chamber for storing a supply of developer material therein. Means, disposed in the chamber of the housing, advance developer material into contact with the photoconductive member to develop the electrostatic latent image recorded thereon. Means are provided for storing a supply of toner particles therein. Means dispense the toner particles from the uppermost portion of the storing means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
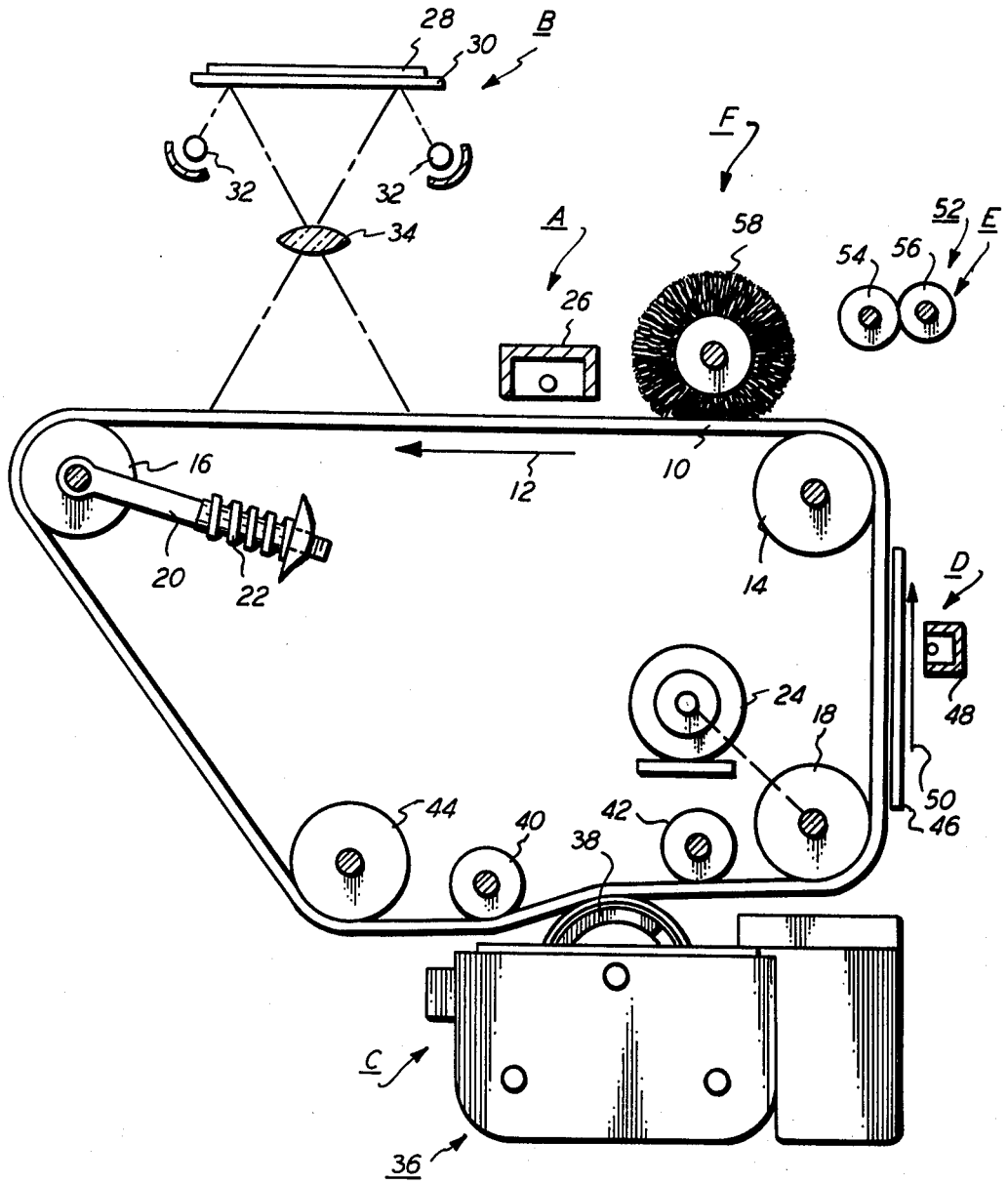
FIG. 1 is a schematic elevational view illustrating an electrophotographic printing machine incorporating the features of the present invention therein.

Referring now to FIG. 1, the electrophotographic printing machine employs a belt 10 having a photoconductive surface deposited on a conductive substrate. Preferably, the photoconductive surface is made from a selenium alloy. The conductive substrate is made preferably from aluminum which is electrically grounded. Belt 10 moves in the direction of arrow 12 to advance successive portions of the photoconductive surface sequentially through the various processing stations disposed about the path of movement thereof. Belt 10 moves over stripping roller 14, tensioning roller 16, and drive roller 18. Tensioning roller 16 is mounted rotatably in a yoke 20. Spring 22, which is initially compressed, resiliently urges yoke 20 in a direction such that roll 16 presses against belt 10. The level of tension is maintained relatively low permitting belt 10 to be easily deflected. Drive roller 18 is mounted rotatably and in engagement with belt 10. Motor 24 rotates roller 18 to advance belt 10 in the direction of arrow 12. Roller 18 is coupled to motor 24 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 26, charges the photoconductive surface of belt 10 to a relatively high, substantially uniform potential.

Next, the charged portion of the photoconductive surface is advanced through exposure station B. At exposure station B, an original document 28 is positioned facedown upon transparent platen 30. Lamps 32 flash light rays onto original document 28. The light rays reflected from original document 28 are transmitted through lens 34 forming a light image thereof. Lens 34 focuses the light image onto the charged portion of the photoconductive surface to selectively dissipate the charge thereon. This records an electrostatic latent image on the photoconductive surface which corresponds to the informational areas contained within original document 28.

Thereafter, belt 10 advances the electrostatic latent image recorded on the photoconductive surface to development station C. At development station C, a magnetic brush development system, indicated generally by the reference numeral 36, advances a developer material into contact with the electrostatic latent image. Preferably, magnetic brush development system 36 includes a developer roller 38. Developer roller 38 transports the brush of developer material comprising magnetic carrier granules and toner particles into contact with belt 10. As depicted in FIG. 1, developer roller 38 is positioned such that the brush of developer material partially deflects belt 10 between idler rollers 40 and 42 in an arc with belt 10 conforming, at least partially, to the configuration of the developer material. The thickness of the layer of developer material adhering to developer roller 38 is adjustable. Toner particles are attracted from the carrier granules to the latent image forming a toner powder image on the photoconductive surface of belt 10. A toner dispenser is operatively associated with the development system to furnish additional toner particles to the chamber of the housing storing the supply of developer material therein. The detailed structure of the development system and its associated toner dispenser will be described hereinafter with reference to FIGS. 2 and 3.

In addition to stripper roller 14, tensioning roller 16 and drive roller 18, an idler roller, indicated generally by the reference numeral 44, is disposed between tensioning roller 16 and drive roller 18. Idler roller 44, in conjunction with drive roller 18, defines a substantially flat belt region for development of the latent image.

With continued reference to FIG. 1, after development, belt 10 advances the toner powder image to transfer station D. At transfer D, a sheet of support material 46 is moved into contact with the toner powder image. Sheet of support material 46 is advanced to transfer station D by a sheet feeding apparatus (not shown). Preferably, the sheet feeding apparatus includes a feed roll contacting the uppermost sheet of the stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 48 which sprays ions onto the back side of sheet 46. This attracts the toner powder image from the photoconductive surface to sheet 46. After transfer, sheet 46 moves in the direction of arrow 50 onto a conveyor (not shown) which advances sheet 46 to fusing station E.

Fusing station E includes a fuser assembly, indicated generally by the reference numeral 52, which permanently affixes the transferred toner powder image to sheet 46. Preferably, fuser assembly 52 includes the heated fuser roller 54 and back-up roller 56. Sheet 46 passes between fuser roller 54 and back-up roller 56 with the toner powder image contacting fuser roller 54. In this manner, the toner powder image is permanently affixed to sheet 46. After fusing, a chute (not shown) guides the advancing sheet 46 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 58 in contact with the photoconductive surface. The particles are cleaned from the photoconductive surface by the rotation of brush 58. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
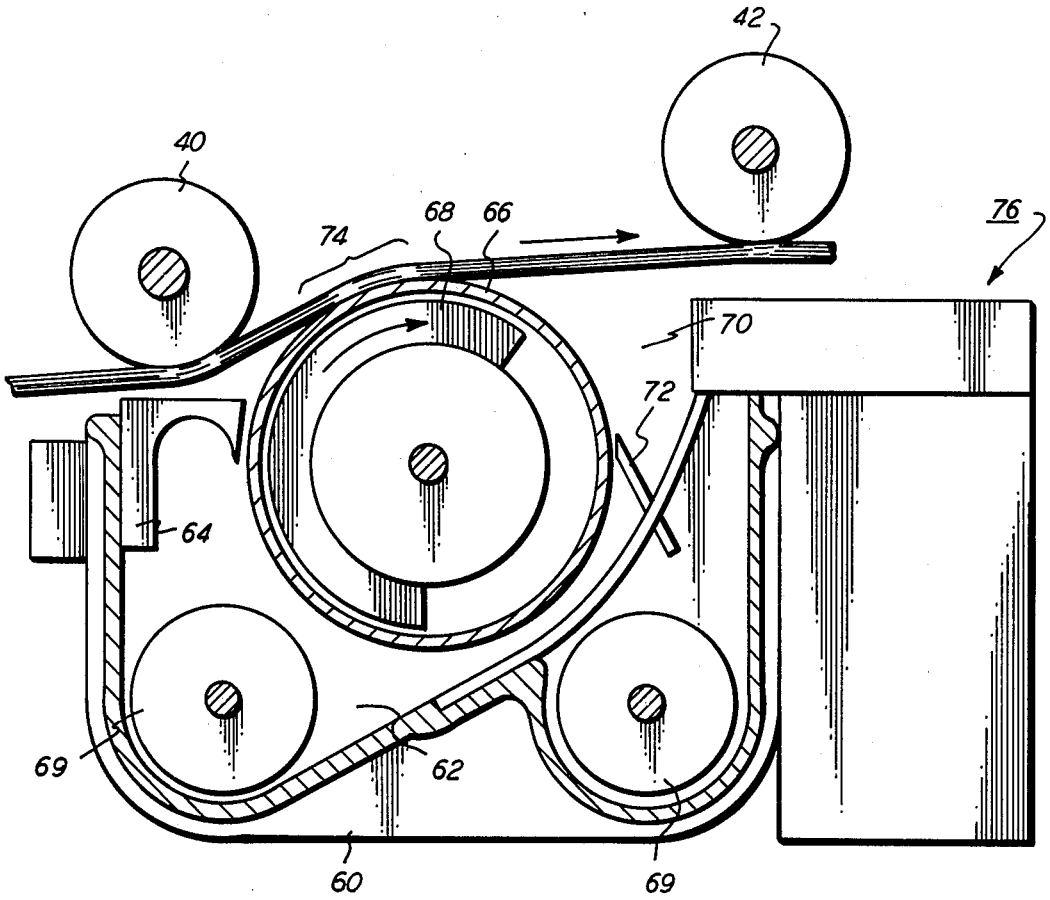
FIG. 2 is a schematic elevational view depicting the development system employed in the FIG. 1 printing machine.

Turning now to FIG. 2, the detailed structure of development system 36 will be described. Development system 36 includes a housing 60 defining a chamber 62 for storing a supply of developer material therein. A pair of augers 69 mix the developer material in chamber 62 of housing 60. Developer roller 38 advances the developer material into contact with the electrostatic latent image recorded on photoconductive belt 10. Trim bar 64 regulates the thickness of the developer pile height on developer roller 38. Developer roller 38 includes a non-magnetic tubular member 66 preferably made from aluminum having the exterior circumferential surface thereof roughened. Elongated magnet 68 is positioned interiorly of and spaced from tubular member 66. Preferably, magnet 68 extends about 200° with exit zone 70 being devoid of magnetic material so as to permit the developer material to fall from tubular member 66 and return to the chamber 62 of housing 60 for subsequent reuse. Blade 72 directs a portion of the used developer material into auger 69 for the purpose of toner addition and mixing. Preferably, tubular member 66 is electrically biased by a voltage source (not shown) to a suitable polarity and magnitude. The voltage level is intermediate that of the background level and the image voltage level recorded on the photoconductive surface of belt 10. By way of example, the voltage source electrically biases tubular member 66 to a voltage range from about 100 volts to about 500 volts. As tubular member 66 rotates at a constant angular velocity, a brush of developer material is formed on the peripheral surface thereof. The brush of developer material advances into contact with belt 10 in development zone 74 and deflects belt 10. Magnet 68 is mounted stationarily to attract the developer material to tubular member 66 due to the magnetic properties of the carrier granules having the toner particles adhering triboelectrically thereto. In development zone 74, these toner particles are attracted from the carrier granules to the latent image so as to form a toner powder image on the photoconductive surface of belt 10. Thus, toner particles are being continually depleted from the developer material. If additional toner particles are not furnished to the developer material, the copies will become progressively lighter and degradate in quality. Additional toner particles are furnished to the developer material by a toner dispenser, indicated generally by the reference numeral 76. The detailed structure of toner dispenser 76 is shown in FIG. 3.

Figure 3:
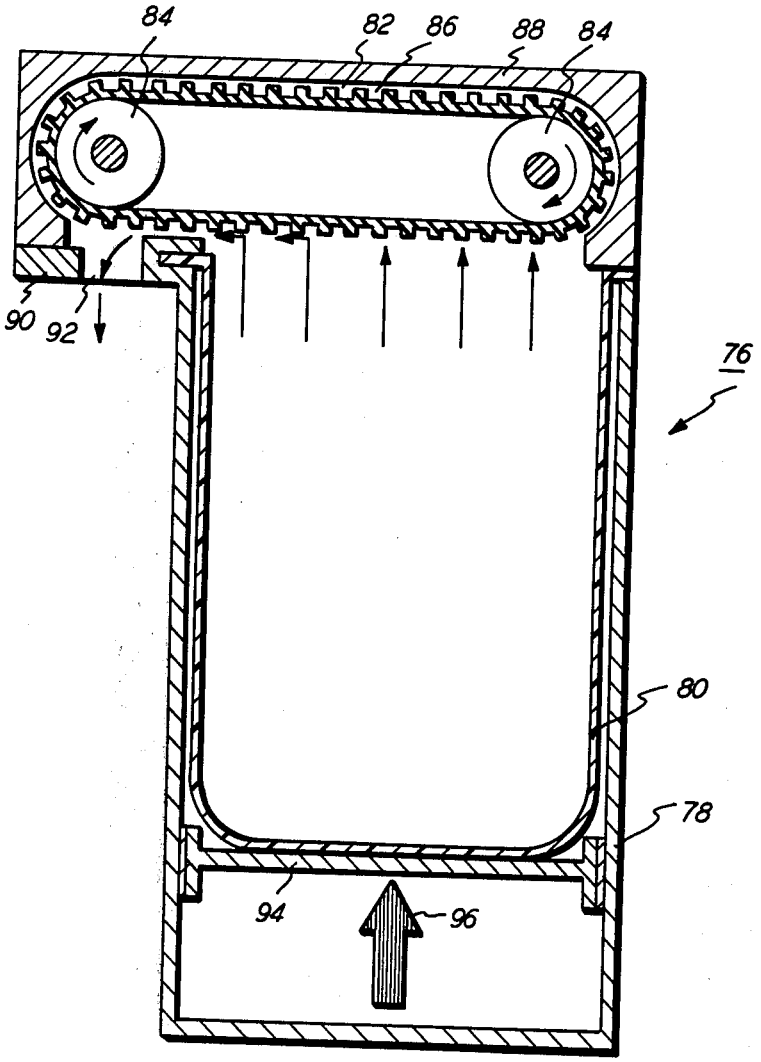
FIG. 3 is a schematic elevational view of the particle dispenser used in the FIG. 2 development system.

As shown in FIG. 3, toner dispenser 76 includes a substantially rigid outer container 78. A bag 80 containing a supply of toner particles therein is disposed interiorly of container 78. Preferably, bag 80 is made from a suitable flexible material such as a plastic. The uppermost portion of container 78 is open-ended. When positioned in container 78, bag 80 is opened to permit toner particles to pass freely from the uppermost portion thereof outwardly. A conveyer belt 82 is entrained about a pair of opposed, spaced rollers and located at the uppermost portion, i.e. the open end, of container 78. Conveyor belt 82 is positioned in chamber 86 in upper housing 88. Upper housing 88 includes a discharge plate 90. Discharge plate 90 has an aperture therein to permit the toner particles to fall from conveyor 82 downwardly into chamber 62 of housing 60. When the toner particles are in chamber 62, augers 69 provide suitable mixing so as to insure that the newly added toner particles are intermingled with the remaining developer material.

By way of example, conveyor belt 82 may be a suitably wide timing belt with rollers 84 being sprocketed rollers meshing therewith. In this way, conveyor belt 82 advances toner particles from the uppermost portion of bag 80 to plate 90 for discharge through aperture 92 therein into chamber 62 of housing 60. A slidably mounted plate 94 is disposed beneath bag 80. As toner particles are depleted from bag 80, plate 94 automatically moves in a vertical direction, as indicated by arrow 96, to insure that a continuous supply of toner particles is maintained in contact with conveyor 82. Plate 94 may be moved in an upwardly direction by being mounted on a suitable spring, or in lieu thereof, by a supply of pressurized air being furnished between plate 94 and the bottom of container 78. In either case, as the weight of toner particles in bag 80 decreases, plate 94 is resiliently urged in an upwardly direction to maintain the uppermost portion or face of the toner particles continuously in contact with conveyor belt 82. In this manner, toner particles are dispensed from aperture 92 of plate 90 into chamber 62 of housing 60. This insures that the concentration of toner particles within the developer material is maintained at a satisfactory level to insure optimum copy quality.

In recapitulation, it is clear that the particle dispensing apparatus of the present invention automatically discharges toner particles from the uppermost portion of the container. This greatly facilitates the opportunities for optimizing space constraints within the printing machine.

It is, therefore, evident that there has been provided in accordance with the present invention, an apparatus for dispensing toner particles that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for dispensing particles including:
a substantially rigid container;
a flexible container disposed interiorly of said rigid container housing the supply of particles therein;
means for discharging particles received from said rigid container in a substantially downwardly direction;
means for transporting a portion of the particles from the uppermost portion of said rigid container to said discharging means; and
means for moving said flexible container relative to said rigid container in an upwardly direction to maintain a continuous supply of particles in communcation with said discharging means.

2. An apparatus according to claim 1, wherein said transporting means includes a conveyor disposed in the uppermost portion of said rigid container to receive particles thereat and advance particles to said discharging means.

3. An apparatus according to claim 2, wherein said moving means includes means, in resilient engagement with said flexible container for urging the supply of particles in an upwardly direction so as to maintain a continuous supply of particles therein in contact with said conveyor.

4. An apparatus for developing an electrostatic latent image recorded on a photoconductive member, including:
a housing defining a chamber for storing a supply of developer material therein;
means, disposed in the chamber of said housing, for advancing developer material into contact with the photoconductive member to develop the electrostatic latent image recorded thereon;
means for storing a supply of toner particles therein;
means for dispensing toner particles from the uppermost portion of said storing means into the chamber of said housing; and
means for moving the supply of toner particles in an upwardly direction relative to said storing means so as to maintain a continuous supply of toner particles in communication with said dispensing means.

5. An apparatus according to claim 4, wherein said dispensing means includes:
means for discharging toner particles from said storing means in a substantially downwardly direction into the chamber of said housing; and
means for transporting a portion of the toner particles from the uppermost portion of said storing means to said discharging means.

6. An apparatus for developing an electrostatic latent image recorded on a photoconductive member, including:
a housing defining a chamber for storing a supply of developer material therein;
means, disposed in the chamber of said housing, for advancing developer material into contact with the photoconductive member to develop the electrostatic latent image recorded thereon;
a substantially rigid container;
a flexible container disposed interiorly of said rigid container housing the supply of toner particles therein;
means for discharging toner particles from said rigid container in a substantially downwardly direction into the chamber of said housing;
means for transporting a portion of the toner particles from the uppermost portion of said rigid container to said discharging means; and
means for moving said flexible container relative to said rigid container in an upwardly direction to maintain a continuous supply of toner particles in communication with said discharging means.

7. An apparatus according to claim 6, wherein said transporting means includes a conveyor disposed in the uppermost portion of said rigid container to receive toner particles thereat and advance the toner particles to said discharging means.

8. An apparatus according to claim 7, wherein said moving means includes means, in resilient engagement with said flexible container, for urging the toner particles in an upwardly direction so as to maintain a continuous supply of toner particles in contact with said conveyor.

* * * * *